US012662917B1

(12) United States Patent
Almutairi et al.

(10) Patent No.: US 12,662,917 B1
(45) Date of Patent: Jun. 23, 2026

(54) ESP HYDRAULIC ACTIVATED VALVE

(71) Applicant: SAUDI ARABIAN OIL COMPANY, Dhahran (SA)

(72) Inventors: Khalid M. Almutairi, Riyadh (SA); Abdul-Rahman M. Aifan, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/303,910

(22) Filed: Aug. 19, 2025

(51) Int. Cl.
*E21B 43/12* (2006.01)

(52) U.S. Cl.
CPC ..... *E21B 43/128* (2013.01)

(58) Field of Classification Search
CPC ..... E21B 43/128; E21B 43/129; E21B 34/08; E21B 34/10
See application file for complete search history.

(56) References Cited

U.S. PATENT DOCUMENTS 4,119,146 A * 10/1978 Taylor ..... E21B 34/16 166/321
9,303,496 B2 * 4/2016 Xiao ..... E21B 43/128
10,167,708 B2 1/2019 Beveridge
10,975,659 B2 * 4/2021 Jordan ..... E21B 43/128
11,346,194 B2 5/2022 Al-Somali et al.
12,203,341 B2 * 1/2025 Xiao ..... E21B 17/18
2004/0060707 A1 * 4/2004 Bearden ..... E21B 41/02 166/380
2008/0295508 A1 * 12/2008 Ma ..... G05D 16/2097 60/459
2008/0308268 A1 * 12/2008 Hill, Jr. ..... E21B 34/14 166/129
2010/0051289 A1 * 3/2010 Constantine ..... E21B 43/14 166/373
2010/0206579 A1 * 8/2010 Guven ..... E21B 23/006 166/373
2013/0206389 A1 * 8/2013 Vick, Jr. ..... E21B 34/102 166/105
2014/0054045 A1 * 2/2014 Bell ..... E21B 34/10 166/375
2015/0369022 A1 * 12/2015 Zhou ..... E21B 7/061 166/50
2016/0222743 A1 * 8/2016 Gosney ..... E21B 21/019
2019/0249789 A1 * 8/2019 John ..... F16K 31/426
2020/0165908 A1 * 5/2020 El-Mahbes ..... E21B 43/127
(Continued)

*Primary Examiner* — Yanick A Akaragwe
(74) *Attorney, Agent, or Firm* — Osha Bergman Watanabe & Burton LLP

(57) ABSTRACT

A system includes a valve and a pressure system. The valve includes a body having a flow path and a closure element movably disposed along a valve channel formed within the body. The closure element comprises side wings on opposite sides that seal and open the flow path. The pressure system, connected to the valve, includes a fluid source that is connected via a flowline to a plurality of nozzles. The nozzles include cleaning nozzles and a jetting nozzle. The cleaning nozzles are disposed circumferentially around the valve channel, and the jetting nozzle has an outlet to direct fluid pressure to the closure element. A first pressure is applied to move the closure element from the closed position to the open position. A second pressure is applied to direct the fluid pressure from the cleaning nozzles into the valve channel. The second pressure is greater than the first pressure.

19 Claims, 6 Drawing Sheets

(56) References Cited

U.S. PATENT DOCUMENTS

| | | | | |
|---|---|---|---|---|
| 2022/0074290 | A1* | 3/2022 | Al-Somali | F16K 1/18 |
| 2025/0154849 | A1* | 5/2025 | Gassen | E21B 34/10 |
| 2025/0334023 | A1* | 10/2025 | McChesney | E21B 34/10 |

* cited by examiner

ESP HYDRAULIC ACTIVATED VALVE

BACKGROUND

An electric submersible pump (ESP) is a tool to lift fluids from wells in an oil production plant. In ESP systems, a Y-tool is commonly used as a downhole tool to provide a bypass line and allow access to a wellbore below the ESP without pulling the entire unit. An ESP blanking plug is one of the main components of the Y-tool and is installed through the production tubing to seal off the bypass line during ESP pump operations. The ESP blanking plug prevents flow recirculation while the ESP is running and allows the ESP to pump fluids to a surface without pressure or flow loss. However, improper installation of the ESP blanking plug can build up sand or debris in the production tubing. This can accumulate in the production tubing and lead to blockages and erosion, which affects ESP performance and well productivity. As a result, it is desirable to prevent flow recirculation from building up the sand or debris in the production tubing, allowing for robust design of the ESP pump or system.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system includes a valve and a pressure system. The valve includes a body and a closure element. The body has a flow path extending axially therethrough. The closure element is movably disposed along a valve channel formed within the body. The closure element comprises side wings on opposite sides. When the closure element is in a closed position, the closure element seals the flow path. When the closure element is in an open position, the flow path is completely open. The pressure system is connected to the valve. The pressure system includes a fluid source. The fluid source is connected via a flowline to a plurality of nozzles positioned around the valve channel. The plurality of nozzles include cleaning nozzles and a jetting nozzle. The cleaning nozzles are disposed circumferentially around the valve channel, and the jetting nozzle has an outlet to direct fluid pressure to the closure element. When a first pressure is applied from the fluid source to the plurality of nozzles, the fluid pressure is directed from the jetting nozzle toward the closure element to move the closure element from the closed position to the open position. When a second pressure is applied from the fluid source to the plurality of nozzles, the fluid pressure is directed from the cleaning nozzles into the valve channel. The second pressure is greater than the first pressure.

A method of using the system includes providing a Y-tool along a production tubing in a well. The system is connected to a bypass line of the Y-tool, and an electric submersible pump (ESP) is connected to a pump line of the Y-tool. The system includes a valve having a flow path extending axially through a body of the valve and a closure element movably disposed along a valve channel formed within the body. When the closure element is in a closed position, the closure element seals the flow path. When the closure element is in an open position, the flow path is completely open. The system further includes a side wing disposed along a side of the valve. The method further includes connecting a pressure system to the valve. The pressure system includes a fluid source fluidly connected via a flowline to a plurality of nozzles positioned around the valve channel. The plurality of nozzles include cleaning nozzles and a jetting nozzle. The method further includes directing hydraulic pressure from the fluid source to the plurality of nozzles. The method also includes applying a first pressure through the jetting nozzle to the closure element to move the closure element to the open position. In addition, the method includes applying a second pressure, greater than the first pressure, through the cleaning nozzles into the valve channel to clean the valve channel. The method further includes releasing the first pressure to slide the closure element back to the closed position.

Any combinations of the various embodiments and implementations disclosed herein can be used in a further embodiment, consistent with the disclosure. Other aspects and advantages of the claimed subject matter will be apparent from the following description and the claims.

BRIEF DESCRIPTION OF DRAWINGS

Specific embodiments of the disclosed technology will be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
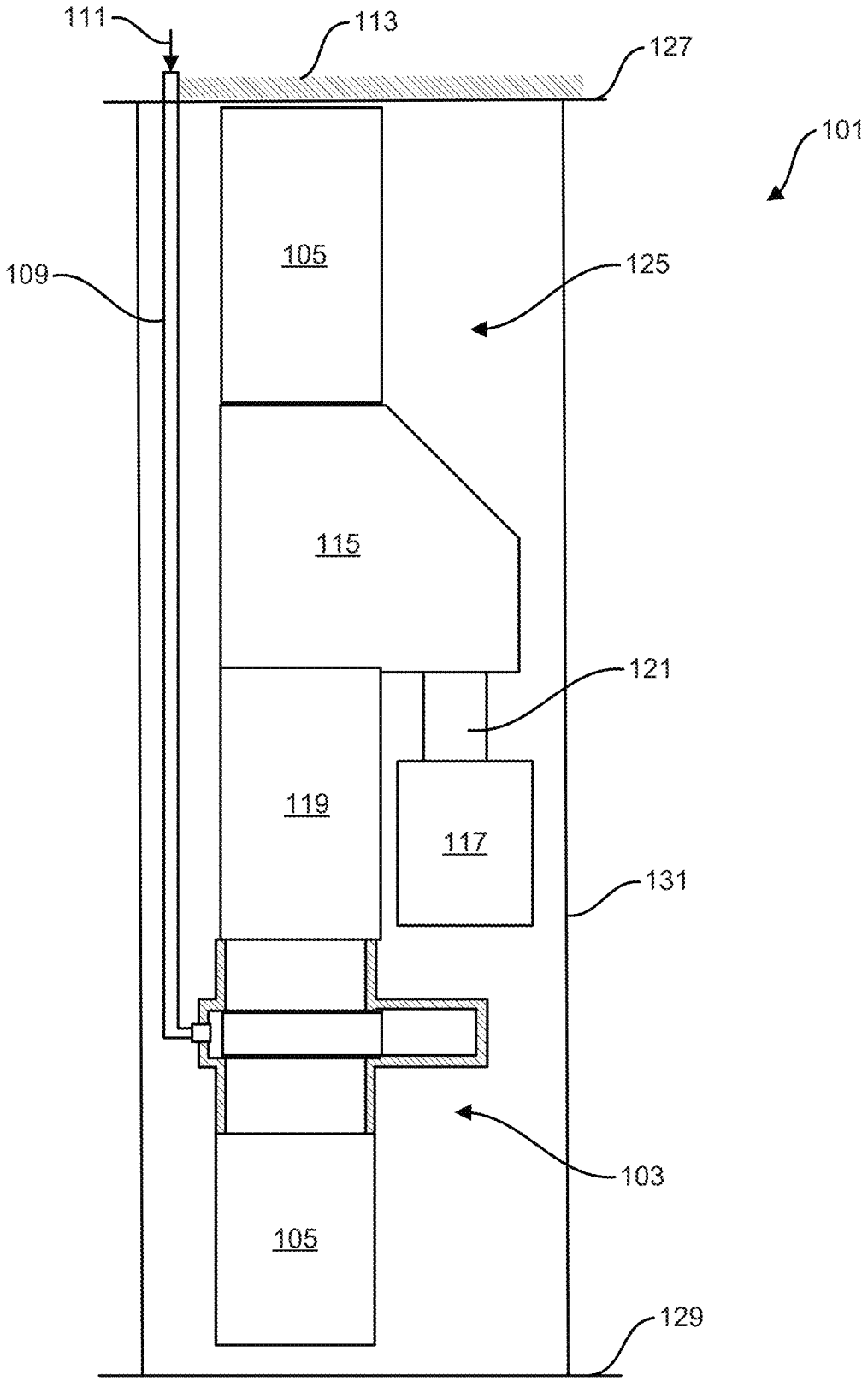
FIG. 1 depicts a system in accordance with one or more embodiments disclosed herein.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, one or more embodiments of the present invention are directed towards a system. The system includes a valve and a pressure system. The valve includes a body and a closure element. The body has a flow path extending axially therethrough. The closure element is movably disposed along a valve channel formed within the body to move between a closed position, where the closure element seals the flow path, and an open position, where the flow path is completely open. The closure element includes side wings on opposite sides. The pressure system is connected to the valve and comprises a fluid source. The fluid source is fluidly connected via a flowline to a plurality of nozzles positioned around the valve channel. The plurality of nozzles includes cleaning nozzles and a jetting nozzle. The cleaning nozzles are disposed circumferentially around the valve channel, and the jetting nozzle has an outlet configured to direct fluid pressure to the closure element. When a first pressure is applied from the fluid source to the plurality of nozzles, fluid pressure is directed through the jetting nozzle towards the closure element to move the closure element from the closed position to the open position. When a second pressure is applied from the fluid source to the plurality of nozzles, fluid pressure is directed from the cleaning nozzles into the valve channel, where the second pressure is greater than the first pressure.

In some embodiments, the closure element may have side wings on opposite lateral sides of the closure element that fit into the valve channel, such that the outlet of the jetting nozzle is configured to direct the fluid pressure through the valve channel to push on the side wings of the closure element in order to move the closure element between the closed and open positions. In some embodiments, the closure element may have a thru-hole positioned in a side portion of the closure element, such that the thru-hole aligns with the valve's flow path when the closure element is in the open position and is enclosed within the valve channel when the closure element is in the closed position. The valve channel allows the closure element to move between the open position and the closed position while maintaining a closed hydraulic system.

FIG. 1 depicts a system 101 in accordance with one or more embodiments disclosed herein. The system 101 includes a valve 103 and a pressure system (e.g., shown in more detail in FIGS. 4A and 4B) connected to and integrated with the valve 103. The valve 103 is connected along a production tubing 105. In the embodiment shown, and an upstream end of the valve 103 is connected to the production tubing 105 via a Y-tool 115, where the valve 103 is fluidly connected to the Y-tool 115 by a bypass line 119. An electric submersible pump (ESP) 117 is connected to a pump line 121 of the Y-tool. The valve 103 and connected Y-tool may be installed along a production tubing 105 at a downhole location in a well 131. The production tubing 105, Y-tool 115, valve 103, and other flow line components may be connected in an axial end-to-end fashion to provide a pipe string 125 extending from the surface of the well to a depth in the well. While the Y-tool and valve assembly is shown in FIG. 1 as being connected to production tubing 105 to form the pipe string 125, those skilled in the art may appreciate that the Y-tool and valve assembly may be connected to other pipe lines and/or tubular components to form the pipe string, e.g., depending on the well operation to be performed (such as tubing for well intervention operations).

In oil and gas production, the ESP 117 is used to lift fluids from the well and increase oil production from the well to bring fluids to a surface 113. In an ESP system, the Y-tool 115 is a key component providing access to a wellbore below the ESP 117 without having to remove the pump. Further, the Y-tool 115 is installed on the production tubing 105, providing a bypass conduit for tools and equipment. The ESP 117 is connected to the Y-tool 115 by a pump line 121, where the ESP 117 aids in lifting well fluid to the surface of the well by pumping fluids from the well, through the pump line 121 of the Y-tool 115, and through the upstream production tubing to the surface 113. The valve 103 and the ESP 117 are in axially spaced apart positions relative to each other. For example, in the embodiment shown in FIG. 1, the ESP 117 is located in an upstream location along the well from the valve 103.

In conventional Y-tool assemblies, ESP blanking plugs are installed through production tubing to the Y-tool to seal the Y-tool's bypass line and prevent flow recirculation while the ESP is running. However, improper installation of the ESP blanking plug may have limitations. For example, improper installation of the ESP blanking plug in the production tubing leads to building up sand or debris in the production tubing, blocking a flow path. This affects ESP performance and productivity. While ESP blanking plugs are one of the main components of conventional Y-tool assemblies, embodiments disclosed herein include Y-tools that do not use a blanking plug. For example, in some embodiments, the Y-tool may not have a blanking plug landing shoulder, which is commonly used in conventional Y-tools to receive blanking plugs.

Instead of a blanking plug, systems and methods according to embodiments of the present disclosure may use a hydraulically activated valve (e.g., valve 103) positioned along the bypass line of the Y-tool to seal the Y-tool's bypass line and prevent flow recirculation while the ESP is running (an operation previously performed with a blanking plug). Furthermore, the valve 103 may provide a 100% seal while the ESP 117 is running. The valve 103 may be controlled hydraulically from the surface 113 using the valve pressure system, which may also clean the sand or debris built up in the valve 103. This improves overall well production performance and minimizes the production downtime.

As shown in FIG. 1, hydraulic fluid 111 from the surface 113 is supplied to a hydraulic line 109. The hydraulic line 109 is fluidly connected to a jetting nozzle (e.g., 205 in FIG. 2). Hydraulic pressure supplied from a fluid source via the hydraulic line 109 may be directed through the jetting nozzle to exert an opening force on a closure element (e.g., a gate) in the valve 103, which may move the closure element to an open position, thereby opening the valve. When the hydraulic pressure is released or stopped, the closure element may move back to the closed position.

Figure 2:
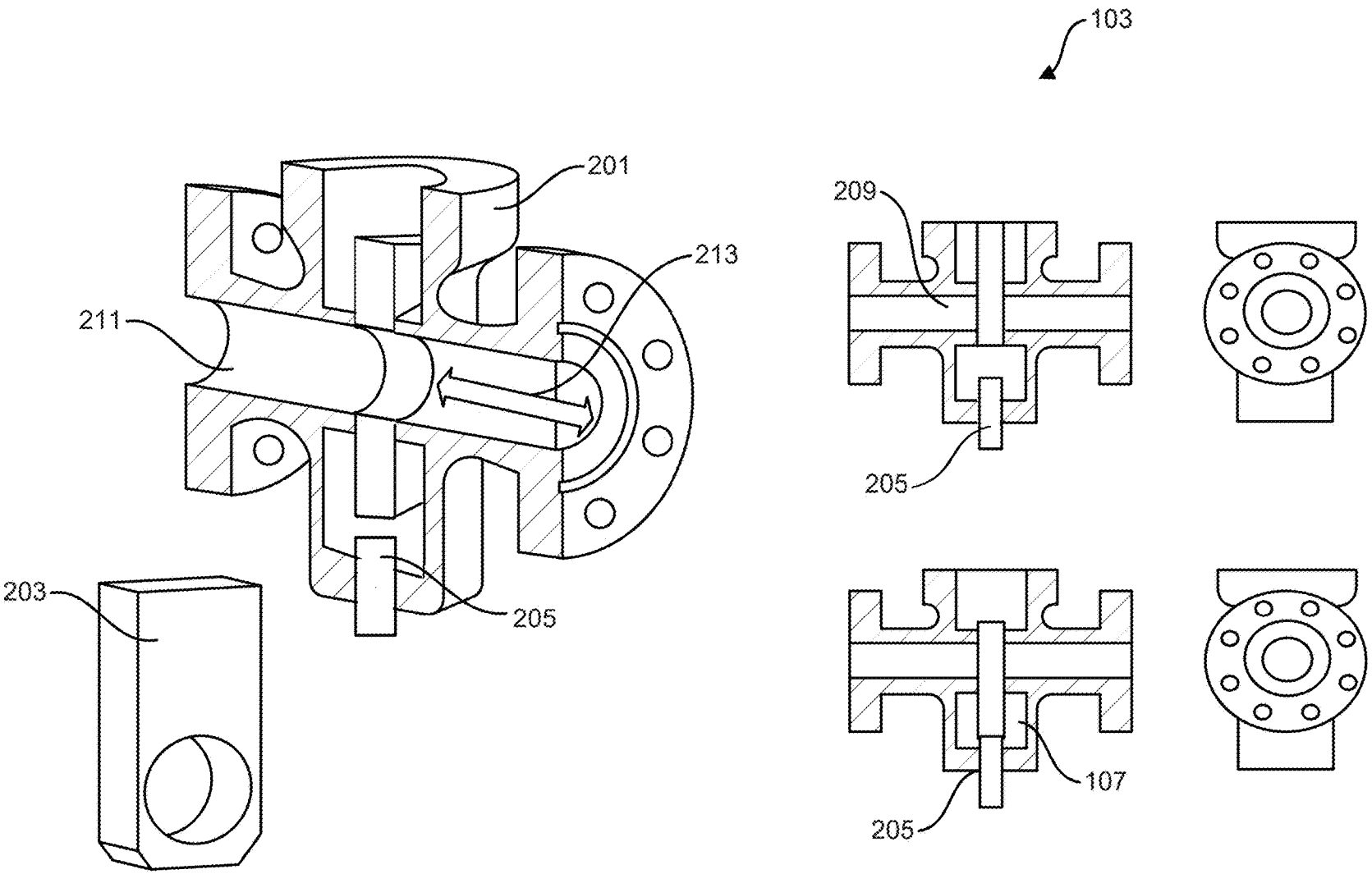
FIG. 2 depicts a valve in accordance with one or more embodiments disclosed herein.

FIG. 2 depicts a valve 103 in accordance with one or more embodiments disclosed herein. Specifically, FIG. 2 depicts a perspective cross-sectional view of the valve 103 in fully open position (top left), a perspective view of the valve's closure element 203 (bottom left), a cross-sectional and top view of the valve 103 in the fully open position (top right), and a cross-sectional and top view of the valve 103 in the fully closed position (bottom right). The valve 103 includes a body 201 and a closure element 203. The valve 103 is disposed along a pipe string 125 in the well 131. When the valve 103 is fully open, well fluids 213 flow through a flow path 211 extending axially through the valve 103. The well fluids 213 refer to any fluid, often water based, used for lubrication and cooling of drill bit cutting surface while drilling. In one or more alternative embodiments, the well fluids 213 may be used for controlling formation of fluid pressure to prevent blowouts, maintaining well stability, minimizing fluid loss through which the well is being drilled, and displacing the fluid within the well.

The valve 103 disclosed herein is a gate valve. The gate valve is a valve that opens by sliding a gate out of the valve's main flow path. Further, the gate valve controls fluids flow by providing a tight shut-off when fully closed and minimizing pressure drop when fully open. In the context of this application, the term "gate" refers to the closure element 203 that slides up and down to control the flow of well fluids. The gate valve not only maintains flow resistance and pressure drop but also provides a tight seal when fully closed. Additionally, the gate valve allows bidirectional flow, meaning the gate valve can control fluid movement in either direction. Thus, the gate will completely shut off the flow of well fluids when the valve 103 is in the closed position. In one or more alternative embodiments, other types of valves including ball valve, globe valve, check valve, control valve may be used.

The closure element 203 is movably disposed along a valve channel 209 formed within the body 201 to open and close the flow path 211. In the context of this application, the term "valve channel" refers to a passage or pathway within the valve that allows the fluids to flow through. The valve channel is directly affected by the position of the closure element 203. When the closure element 203 is raised, it opens the valve channel 209, allowing the flow of well fluids 213 through the flow path 211. In contrast, when the closure element 203 is lowered, it blocks the valve channel 209, stopping the flow of well fluids 213 through the flow path 211. Further, the valve channel 209 allows the closure element 203 to move between the open position and the closed position while maintaining a closed hydraulic system. The hydraulic pressure to push the valve open in the closed fluid system does not allow the hydraulic fluid 111 to mix with fluids flowing through the open valve. The closed hydraulic system keeps the hydraulic fluid 111 and the well fluids separate in the open position within the system 101. A plurality of nozzles is positioned around the valve channel 209, such that the outlets of the nozzles interface with the interior of the valve channel 209. The nozzles may include one or more jetting nozzles and cleaning nozzles, discussed more below. The hydraulic line 109 may supply fluid to the nozzles at selected pressures. The jetting nozzle(s) and cleaning nozzles may be configured to open at different fluid pressures. For example, the jetting nozzle(s) and/or cleaning nozzles may be spring-loaded nozzles, pressure relief valves, or other pressure-activated nozzles and/or may be connected to pressure relief valves. According to embodiments of the present disclosure, jetting nozzle(s) may be configured to open and eject fluid at a lower fluid pressure than the cleaning nozzles.

As discussed above, the hydraulic fluid 111 is supplied to a jetting nozzle 205 by the hydraulic line 109. The jetting nozzle 205 is connected to a hydraulic pump by the hydraulic line, supplying the hydraulic fluid 111 at a fluid pressure. In some embodiments, a side pocket 107 extending at least partially around the valve channel 209 may fluidly connect the hydraulic line 109 to the jetting nozzle 205. In such embodiments, the side pocket 107 may be an enclosed fluid passage around the valve channel 209 that allows the hydraulic fluid to flow from the hydraulic line to the jetting nozzle 205. The jetting nozzle 205 is positioned around the side pocket 107 such that the outlet of the jetting nozzle 205 is fluidly connected to the interior of the valve channel 209. For example, the jetting nozzle 205 may extend from the side pocket 107 through a valve channel wall to interface with the interior of the valve channel 209. When fluid is ejected through the jetting nozzle 205 into the valve channel 209, the fluid pressure may exert an opening force onto the closure element 203 to move the closure element 203 in a direction from the closed position to the open position.

Figure 3A:
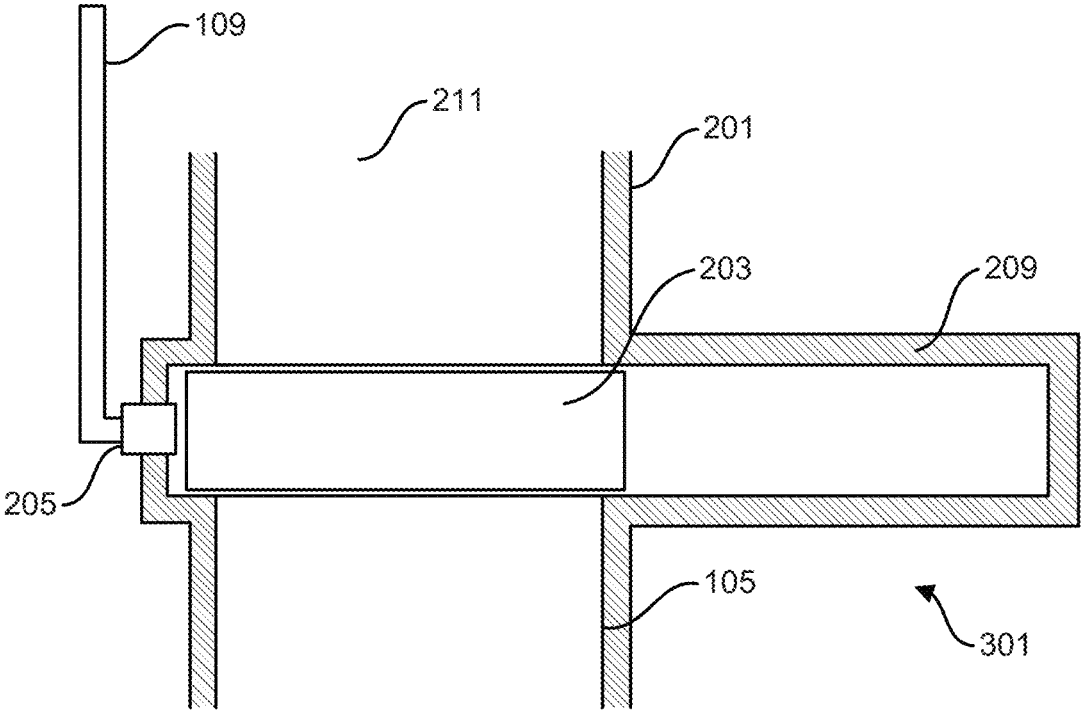
FIGS. 3A and 3B depict a sectional view of the valve in accordance with one or more embodiments disclosed herein.
Figure 3B:
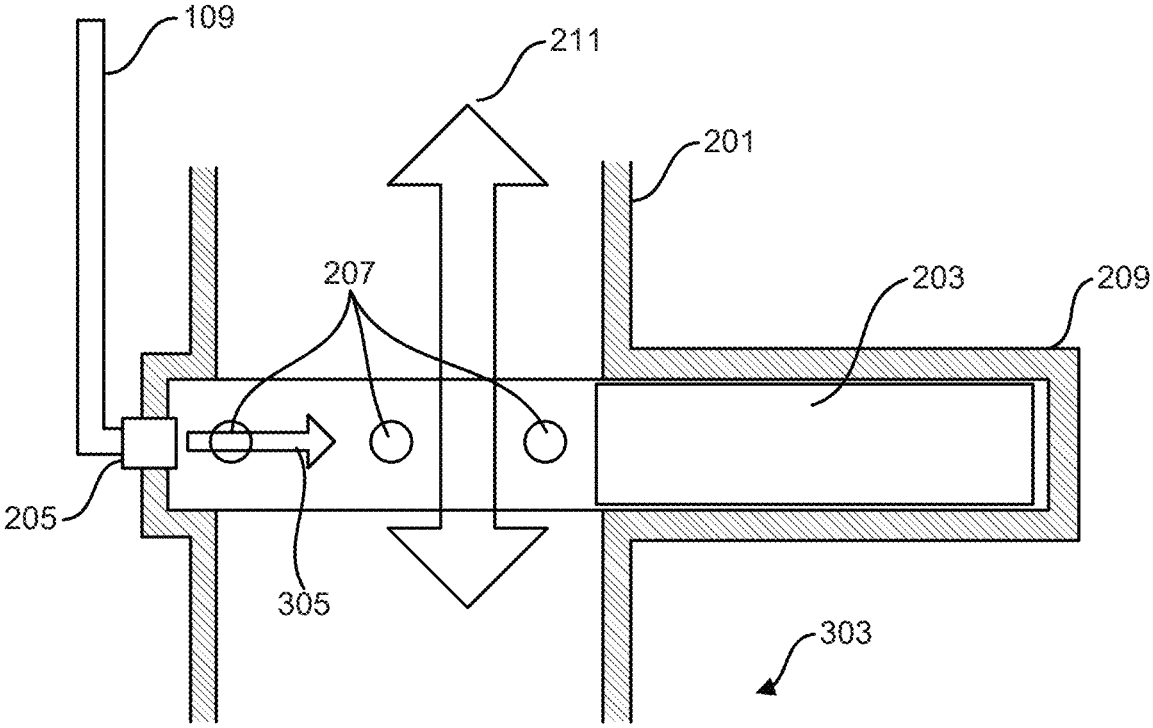

In one aspect, embodiments disclosed herein relate to different valve positions. FIGS. 3A and 3B illustrate arrangements of components in an open and a closed position with one or more embodiments disclosed herein. Specifically, FIG. 3A illustrates the valve in the closed position 301. When the valve 103 is closed, the closure element 203 is positioned to extend across the flow path 211 (shown on the left side of the valve channel 209 in FIGS. 3A-B) such that the closure element blocks well fluids flowing through the flow path 211 within the production tubing 105. To close the valve 103, surface pressure is released from the hydraulic line 109.

Referring now to FIG. 3B, FIG. 3B illustrates the valve 103 in the open position 303. When the valve is in the open position 303, the closure element 203 slides through the valve channel 209 to a position that clears the flow path 211 (shown on the right side of the valve channel 209 in FIGS. 3A-B) to completely open the flow path 211. To keep the valve at the open position 303, the fluid pressure used to move the closure element open (supplied via the hydraulic line 109 and jetting nozzle 205) is applied.

Further, according to embodiments of the present disclosure, the hydraulic line 109 may be fluidly connected to a plurality of cleaning nozzles 207. The outlets of the cleaning nozzles may interface with the interior of the valve channel 209 such that when fluid supplied via the hydraulic line 109 exits the cleaning nozzles, the fluid may be ejected into the valve channel 209. The cleaning nozzles 207 are used to flush and clean the sand or debris built up in the production tubing 105, allowing the well fluids 213 flow smoothly in the flow path 211.

Figure 4A:
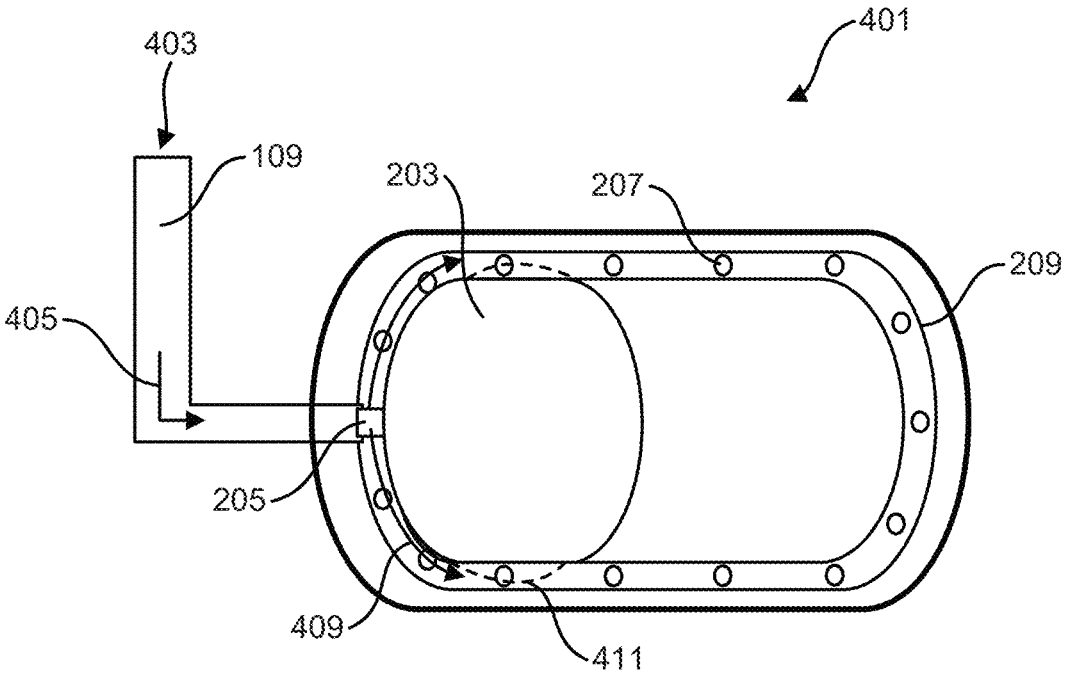
FIGS. 4A and 4B depict a pressure system in accordance with one or more embodiments disclosed herein.
Figure 4B:
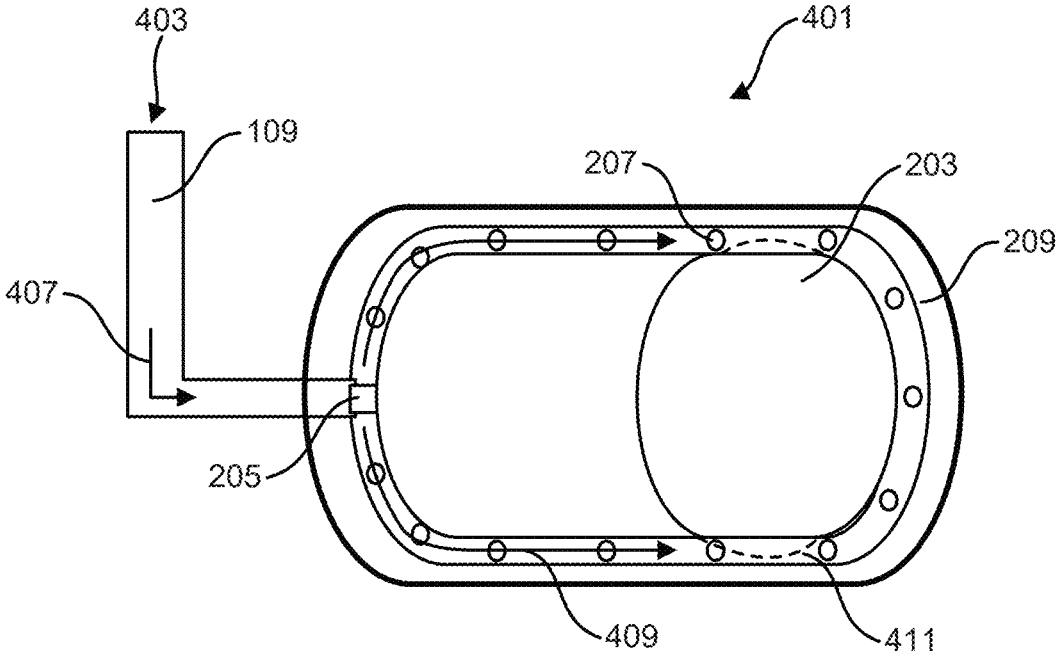

In one aspect, embodiments disclosed herein relate to a pressure system 401 supplying a fluid pressure 409 to the valve 103. FIG. 4A illustrates the pressure system 401 with a first pressure 405, and FIG. 4B illustrates the pressure system 401 with a second pressure 407. As illustrated in FIG. 4A, the pressure system 401 is connected to the valve 103. The pressure system 401 includes a fluid source 403, and the fluid source 403 is connected to a plurality of nozzles by a hydraulic line 109. The plurality of nozzles is positioned around the valve channel 209. In one or more embodiments, the plurality of nozzles is spring-loaded nozzles. The spring-loaded nozzles are beneficial because they can maintain consistent pressure regardless of flow rate changes.

Further, the plurality of nozzles includes cleaning nozzles 207 and a jetting nozzle 205. The cleaning nozzles 207 are disposed circumferentially around the valve channel 209. The cleaning nozzles 207 are used to flush and clean the sand or debris inside the valve channel 209. Pressure (e.g., second pressure 407) to activate the cleaning nozzles 207 may be greater than the pressure (e.g., first pressure 405) to activate the valve 103. For example, if 1000 psi is required to open the valve 103 via the jetting nozzle 205, 1200 psi may be the minimum fluid pressure required to activate the cleaning nozzles. The jetting nozzle 205 has an outlet passage configured to direct fluid pressure to the closure element 203. Both the jetting nozzle 205 and the cleaning nozzles 207 may be spring-loaded nozzles, which utilize a spring mechanism to control spray pattern or flow rate. For example, when the pressure is applied, the spring is compressed, and the nozzles change the spray pattern by adjusting orifice size.

As shown in FIG. 4A, the first pressure 405 is supplied from the fluid source 403 to the plurality of nozzles, and fluid pressure 409 is directed from the jetting nozzle 205 toward the closure element 203 to move the closure element 203 from the closed position 301 to the open position 303. FIG. 4B depicts the pressure system 401 with a second pressure 407. The second pressure 407 is supplied from the fluid source 403 to the plurality of nozzles, and the fluid pressure 409 is directed from the cleaning nozzles 207 into the valve channel 209. The second pressure 407 is greater than the first pressure 405. To slide the closure element 203 back to the closed position 301, the first pressure 405 is released from the pressure system 401.

Figure 5A:
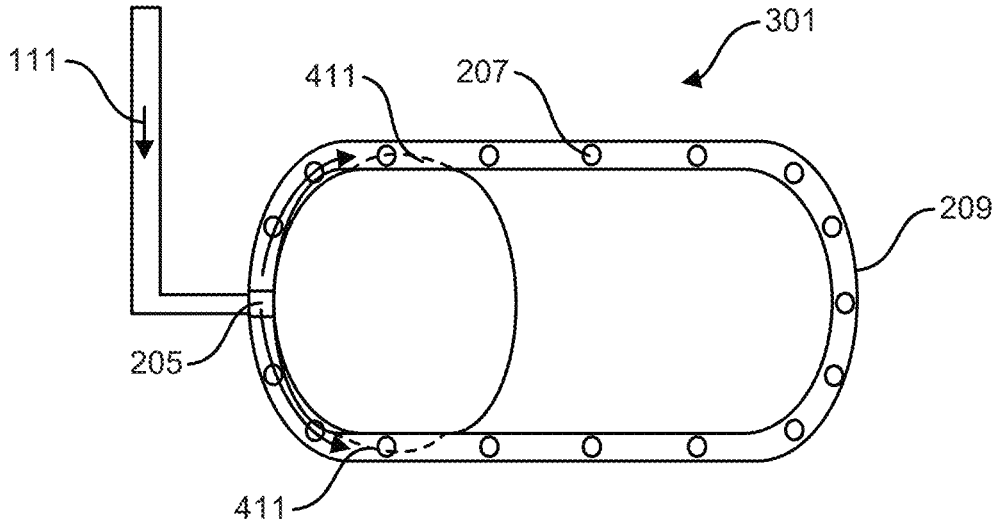
FIGS. 5A and 5B depict a top view of the system in accordance with one or more embodiments disclosed herein.
Figure 5B:
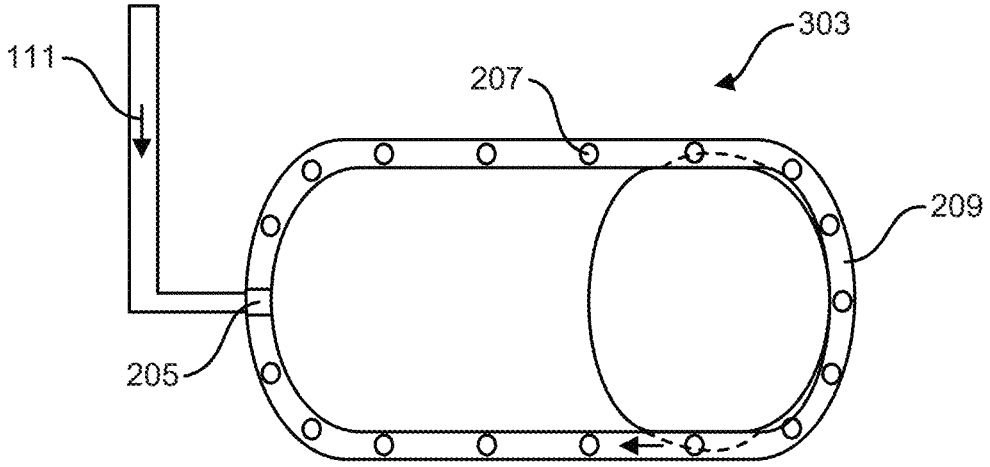

FIGS. 5A and 5B illustrate a top view of another example of a valve system in accordance with one or more embodiments disclosed herein. In the embodiment shown in FIGS. 5A-B, the valve closure element has wings provided on opposite lateral sides of the closure element. The wings may extend laterally into the valve channel and interface or indirectly connect with a fluid passage from the jetting nozzle 205, such that fluid pressure provided from the jetting nozzle and through the fluid passage may push on the wings of the closure element to move the closure element towards the open position.

FIG. 5A shows the top view of the valve system in the closed position 301. The closure element 203 has side wings 411 on opposite sides. The jetting nozzle 205 sprays the hydraulic fluid 111 to the side wings 411 of the valve to slide the valve from the closed position to the open position. As discussed above, a first fluid pressured may be directed from the jetting nozzle to the closure element to slide the valve from the closed position to the open position.

Turning to FIG. 5B, FIG. 5B shows the top view of the system in the open position. As discussed above, a second fluid pressure (greater than the first fluid pressure) may be directed from the cleaning nozzles to the valve channel to clean the valve channel.

Figure 6:
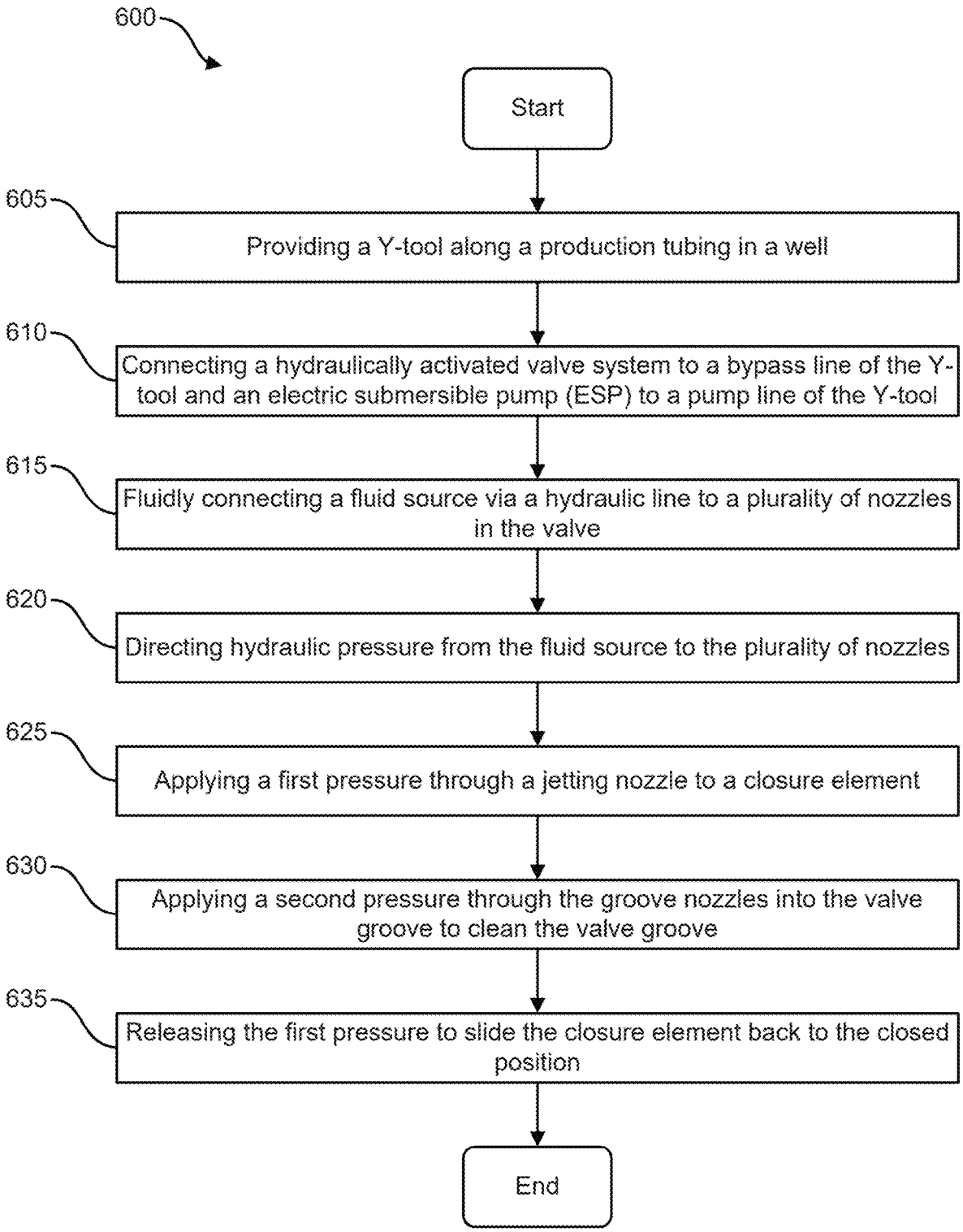
FIG. 6 depicts a flowchart of a method in accordance with one or more embodiments disclosed herein.

FIG. 6 depicts a method 600 in accordance with one or more embodiments. Steps of FIG. 6 may be performed by systems as described herein, but are not limited thereto. Furthermore, the steps of FIG. 6 may be performed in any order, such that the steps are not limited to the sequence presented. In addition, multiple steps of FIG. 6 may be performed as a single action, or one step may comprise multiple actions by devices or components described herein.

The method 600 of FIG. 6 initiates at step 605, which includes providing a Y-tool 115 along a production tubing 105 in a well 131. The Y-tool 115 is installed along the production tubing 105 in the well 131, e.g., by connecting an opening of the Y-tool 115 to an axial end of a production tubing 105. In some embodiments, additional production tubing may be connected to the Y-tool 115 via the bypass line of the Y-tool 115.

In step 610, a hydraulically activated valve system is connected to a bypass line of the Y-tool 115, and an electric submersible pump (ESP) 117 is connected to a pump line of the Y-tool 115. The valve system includes a valve 103 and a pressure system 401. The valve system is installed at a downhole location in the well 131. The valve 103 includes a body 201 and a closure element 203. Specifically, the valve 103 is a gate valve and opens the valve 103 by sliding a gate out of the path of the fluid. The body 201 has a flow path extending axially therethrough. The closure element 203 is movably disposed along a valve channel 209 formed within the body 201. The closure element 203 seals the flow path 211 when the closure element 203 is in a closed position 301. When the closure element 203 is in an open position 303, the flow path 211 is completely open. In some embodiments, the closure element may have side wings disposed along opposite lateral sides of the closure element.

Step 615 includes connecting a pressure system 401 to the valve 103. The pressure system 401 is a closed hydraulic system isolated from the flow path 211 of the valve 103. The pressure system 401 has a fluid source 403 that is fluidly connected to a plurality of nozzles by a hydraulic line 109. The fluid source 403 is at a surface location. The plurality of nozzles may be positioned around the valve channel 209.

In step 620, hydraulic pressure from the fluid source 403 is directed to the plurality of nozzles. The plurality of nozzles may be spring-loaded nozzles. Further, the plurality of nozzles includes cleaning nozzles 207 and a jetting nozzle 205. The cleaning nozzles 207 are disposed circumferentially around the valve channel 209. The jetting nozzle 205 is connected to a hydraulic pump by a flow line, and the jetting nozzle 205 has an outlet fluidly connected to a passage inside the valve channel 209. The passage is configured to direct fluid pressure 409 to the closure element 203.

In step 625, a first pressure 405 is applied through the jetting nozzle 205 to the closure element 203. When at least the first pressure 405 is applied from the fluid source 403 to the plurality of nozzles, the fluid pressure 409 opens the jetting nozzle 205 and is directed from the jetting nozzle 205 toward the closure element 203 to move the closure element 203 from the closed position 301 to the open position 303. In some embodiments, the jetting nozzle 205 sprays hydraulic fluid 111 to side wings 411 of the closure element 203 to slide the closure element 203 from the closed position 301 to the open position 303.

The ESP 117 may operate while the closure element 203 is in the closed position 301. However, prior to moving the closure element 203 to the open position 303, the ESP 117 may be turned off.

In step 630, a second pressure 407, greater than the first pressure 405, is applied through the cleaning nozzles 207 into the valve channel 209 to clean the valve channel 209. When the second pressure 407 is applied from the fluid source 403 to the plurality of nozzles, the fluid pressure 409 opens the cleaning nozzles 207 and is directed from the cleaning nozzles 207 into the valve channel 209. Because the second pressure 407 is greater than the first pressure 405, the second pressure 407 may open both the jetting nozzle 205 and cleaning nozzles 207.

Step 635 includes releasing the first pressure 405 (lowering the fluid pressure 409 supplied via the hydraulic line 109 to less than the first pressure 405) to slide the closure element 203 back to the closed position 301. When the closure element 203 is moved back to the closed position 301, the ESP 117 may again be operated, e.g., to pump well fluids to the surface of the well.

Thus, the method 600 concludes with opening and closing the valve 103 hydraulically to prevent building up sand or debris in the production tubing 105. As discussed above, the system 101 greatly improves the ESP performance and minimizes the production downtime. As a further benefit of this system, the system 101 flushes and cleans the valve channel 209 without the need of the ESP blanking plug, providing 100% sealing while the ESP 117 is running.

Although only a few example embodiments have been described in detail above, those skilled in the art will readily appreciate that many modifications are possible in the example embodiments without materially departing from this invention. For example, it will be appreciated that particular shapes may vary. In addition, many modifications will be appreciated by those skilled in the art to adapt a particular component, situation, or material to embodiments of the disclosure without departing from the essential scope thereof. Accordingly, all such modifications are intended to be included within the scope of this disclosure as defined in the following claims.

Unless otherwise indicated, all numbers expressing quantities used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by one or more embodiments described herein. At the very least, and not as an attempt to limit the application of the doctrine of equivalents to the scope of the claim, each numerical parameter should at least be construed in light of the number of reported significant digits and by applying ordinary rounding techniques.

What is claimed is:

1. A system comprising:
a valve, comprising:
a body having a flow path extending axially therethrough;
a closure element movably disposed along a valve channel formed within the body,
wherein the closure element comprises side wings on opposite sides,
wherein when the closure element is in a closed position, the closure element seals the flow path, and
wherein when the closure element is in an open position, the flow path is completely open; and
a pressure system connected to the valve, the pressure system comprising:
a fluid source fluidly connected via a flowline to a plurality of nozzles positioned around the valve channel, the plurality of nozzles comprising:
cleaning nozzles disposed circumferentially around the valve channel; and
a jetting nozzle having an outlet configured to direct fluid pressure to the closure element;
wherein, when a first pressure is applied from the fluid source to the plurality of nozzles, the fluid pressure is directed from the jetting nozzle toward the closure element to move the closure element from the closed position to the open position, and
wherein, when a second pressure is applied from the fluid source to the plurality of nozzles, the fluid pressure is directed from the cleaning nozzles into the valve channel,
wherein the second pressure is greater than the first pressure.

2. The system of claim 1, further comprising a Y-tool connected to the system by a bypass line of the Y-tool.

3. The system of claim 2, further comprising an electrical submersible pump (ESP) fluidly connected to the Y-tool by a pump line.

4. The system of claim 3, wherein the system and the ESP are in axially spaced apart positions relative to each other.

5. The system of claim 1, wherein the jetting nozzle is connected to a hydraulic pump by the flowline.

6. The system of claim 1, wherein the system is installed at a downhole location in a well, and the fluid source is at a surface location.

7. The system of claim 1, wherein the plurality of nozzles is spring-loaded nozzles.

8. The system of claim 1, wherein the valve is a gate valve.

9. The system of claim 1, wherein the pressure system is a closed hydraulic system isolated from the flow path of the valve.

10. The system of claim 1, wherein the jetting nozzle sprays hydraulic fluid to the side wings to slide the valve to open the valve.

11. A method of using a system comprising:
providing a Y-tool along a production tubing in a well,
wherein the system is connected to a bypass line of the Y-tool, and an electric submersible pump (ESP) is connected to a pump line of the Y-tool, and
wherein the system comprises:
a valve having a flow path extending axially through a body of the valve; and
a closure element movably disposed along a valve channel formed within the body,
wherein when the closure element is in a closed position, the closure element seals the flow path, and
wherein when the closure element is in an open position, the flow path is completely open;
a side wing disposed along a side of the valve;
connecting a pressure system to the valve, the pressure system comprising:
a fluid source fluidly connected via a flowline to a plurality of nozzles positioned around the valve channel, wherein the plurality of nozzles comprises cleaning nozzles and a jetting nozzle;
directing hydraulic pressure from the fluid source to the plurality of nozzles, comprising:
applying a first pressure through the jetting nozzle to the closure element to move the closure element to the open position;
applying a second pressure, greater than the first pressure, through the cleaning nozzles into the valve channel to clean the valve channel; and
releasing the first pressure to slide the closure element back to the closed position.

12. The method of claim 11, further comprising operating the ESP while the closure element is in the closed position.

13. The method of claim 11, further comprising turning off the ESP prior to moving the closure element to the open position.

14. The method of claim 11, wherein the jetting nozzle is spring activated to an open configuration when the first pressure is applied to the jetting nozzle.

15. The method of claim 11, wherein the jetting nozzle sprays hydraulic fluid to the side wing to slide the valve.

16. The method of claim 11, further comprising sliding the valve to open the valve.

17. The method of claim 11, further comprising installing the system at a downhole location in the well, wherein the fluid source is at a surface.

18. The method of claim 11, further comprising isolating the pressure system, a closed hydraulic system, from the flow path of the valve.

19. The method of claim 11, wherein the hydraulic fluid flows within a closed hydraulic system.

* * * * *